US011804346B2

(12) United States Patent
Fukuda

(10) Patent No.: US 11,804,346 B2
(45) Date of Patent: Oct. 31, 2023

(54) VACUUM INTERRUPTER AND VACUUM BREAKER

(71) Applicant: MEIDENSHA CORPORATION, Tokyo (JP)

(72) Inventor: Hideaki Fukuda, Numazu (JP)

(73) Assignee: MEIDENSHA CORPORATION, Tokyo (JP)

( * ) Notice: Subject to any disclaimer, the term of this patent is extended or adjusted under 35 U.S.C. 154(b) by 0 days.

(21) Appl. No.: 17/913,491

(22) PCT Filed: Mar. 18, 2021

(86) PCT No.: PCT/JP2021/011123
§ 371 (c)(1),
(2) Date: Sep. 26, 2022

(87) PCT Pub. No.: WO2021/193359
PCT Pub. Date: Sep. 30, 2021

(65) Prior Publication Data

US 2023/0118133 A1 Apr. 20, 2023

(30) Foreign Application Priority Data

Mar. 23, 2020 (JP) ..... 2020-051903

(51) Int. Cl.
*H01H 33/662* (2006.01)
*H01H 33/66* (2006.01)
(Continued)

(52) U.S. Cl.
CPC .... *H01H 33/66238* (2013.01); *H01H 33/664* (2013.01); *H01H 33/666* (2013.01); *H01H 33/6606* (2013.01)

(58) Field of Classification Search
CPC ..... H01H 33/66238; H01H 33/6606; H01H 33/664; H01H 33/666; H01H 33/662;
(Continued)

(56) References Cited

U.S. PATENT DOCUMENTS 4,081,640 A * 3/1978 Rich ..... H01H 33/664 218/123
4,088,860 A * 5/1978 Abe ..... H01H 33/66261 218/136
(Continued)

FOREIGN PATENT DOCUMENTS

EP 1 045 498 A2 10/2000
JP S56-117444 U1 9/1981
(Continued)

OTHER PUBLICATIONS

Translation of JP2003257292 (Orignal document published Sep. 12, 2003) (Year: 2003).*

*Primary Examiner* — William A Bolton
(74) *Attorney, Agent, or Firm* — Foley & Lardner LLP

(57) ABSTRACT

An arc shield surrounding an outer peripheral side of a fixed electrode and a movable electrode is provided, in addition to a fixed-side insulating unit in which a fixed-side insulator is provided to be connected coaxially with the arc shield on the fixed side in the axial direction of the arc shield, and a movable-side insulating unit in which movable-side insulators are provided to be connected coaxially with the arc shield on the movable side in the axial direction of the arc shield. The movable-side insulating unit has an insulator group in which movable-side insulators are provided to be connected in the axial direction, an insulator-group-side sub shield surrounding the outer peripheral side of a movable-side energizing shaft, and an insulator-group-side sub shield support part which is on the outer peripheral surface of the
(Continued)

insulator-group-side sub shield and interposed between two adjacent movable-side insulators of the insulator group.

10 Claims, 5 Drawing Sheets

(51) Int. Cl.
*H01H 33/664* (2006.01)
*H01H 33/666* (2006.01)

(58) Field of Classification Search
CPC ... H01H 33/66261; H01H 2033/66276; H01H 2033/66292
USPC ..... 218/118, 136, 137, 138, 147
See application file for complete search history.

(56) References Cited

U.S. PATENT DOCUMENTS 4,665,287 A * 5/1987 Sofianek ..... H01H 33/66261 218/136
4,847,456 A * 7/1989 Bamford ..... H01H 33/6645 218/141
8,445,804 B2 * 5/2013 Schellekens ..... H01H 33/66261 218/139
8,575,509 B2 * 11/2013 Marchand ..... H01H 33/664 218/126
8,847,097 B2 * 9/2014 Renz ..... H01H 33/66261 218/136
9,082,572 B2 * 7/2015 Yoshida ..... H01H 33/6606
9,123,490 B2 * 9/2015 Baron ..... H01H 33/662
2011/0278262 A1 11/2011 Ryu
2014/0251958 A1 * 9/2014 Wang ..... H01H 33/66261 218/137
2017/0148590 A1 * 5/2017 Li ..... H01H 33/6606
2018/0005784 A1 1/2018 Nagatake et al.

FOREIGN PATENT DOCUMENTS

JP 01-175137 A 7/1989
JP H10-224923 A 8/1998
JP 2000-294090 A 10/2000
JP 5243575 B2 7/2013
JP 6044645 B2 12/2016

* cited by examiner

VACUUM INTERRUPTER AND VACUUM BREAKER

TECHNICAL FIELD

The present invention relates to a vacuum breaker applied to, for example, various power facilities, and to a vacuum interrupter which can be applied to the vacuum breaker.

BACKGROUND TECHNOLOGY

As a vacuum breaker applied to, for example, a power facility, one incorporating a vacuum interrupter as a current breaking unit has been known. In these vacuum breaker and vacuum interrupter, recently, the expansion of application to high-voltage power system has been expected, and various improvement has been considered in order to obtain a desired characteristic (for example, insulation performance).

A numeral "9" in FIG. 4 indicates a commonly known vacuum interrupter, and a vacuum vessel 91 is used in which a fixed side that is one end side in the axial direction of an insulating cylindrical body 90 (hereinafter is simply referred to as "axial direction") is sealed with a fixed-side flange 91*a* and a movable side that is the other end side in the axial direction is sealed with a movable-side flange 91*b*. The cylindrical body 90 is one including an arc shield 9*c*, a fixed-side insulating unit 9*a* and a movable-side insulating unit 9*b* each having a cylindrical shape, and has a structure in which the arc shield 9*c* is sandwiched between the fixed-side insulating unit 9*a* and the movable-side insulating unit 9*b* so as to be coaxially arranged.

A fixed-side energizing shaft 92*a* is provided on the vacuum vessel 91 inner side of the fixed-side flange 91*a* so as to extend from the vacuum vessel 91 inner side in the axial direction, and a fixed electrode 93*a* is supported on an end portion of the fixed-side energizing shaft 92*a*. The movable-side flange 91*b* is provided with a movable-side energizing shaft 92*b* extending in the axial direction so as to pass through the movable-side flange 91*b* in the axial direction.

The movable-side energizing shaft 92*b* is supported on the vacuum vessel 91 inner side of the movable-side flange 91*b* via a bellows 92*c* which is freely extensible in the axial direction, so as to be freely movable in the axial direction. A movable electrode 93*b* is supported on an end portion of the movable-side energizing shaft 92*b* so as to come in contact with and separate from the fixed electrode 93*a* according to the movement of the movable-side energizing shaft 92*b*.

In a patent document 1, a configuration is disclosed in which, in addition to an arc shield which surrounds the outer peripheral side of contacts, shields which are referred to as sub shields (in the following, the arc shield and the sub shields are simply referred to as shields as needed) are disposed in order to reduce an electric field value of the end portion of each of the shields. Specifically, a configuration is disclosed in which a vacuum vessel having a multistage insulating structure in which a plurality of cylindrical insulators are provided so as to be connected to each other in the axial direction is applied, and the shields are supported between two adjacent cylindrical insulators (for example, FIG. 1 and FIG. 8 in the patent document 1).

A vacuum interrupter as a single body shown in, for example, the patent document 1 has insulation performance to a certain extent, such that even in case of being incorporated in a vacuum breaker whose outer peripheral side is covered with an insulating tube, a desired insulation performance can be obtained. As an application example of such a vacuum interrupter, for example, as shown in a patent document 2, a configuration has been known in which two vacuum interrupters are incorporated in series per phase of a vacuum breaker so as to improve insulation performance by dividing voltage applied at the time of contact opening.

PRIOR ART REFERENCE(S)

Patent Document(s)

Patent Document 1: Japanese Patent No. 5243575
Patent Document 2: Japanese Patent No. 6044645
Patent Document 3: Japanese Patent Application Publication No. H10-224923

SUMMARY OF THE INVENTION

Each of the shields provided to the above-mentioned vacuum interrupter acts as a floating electrode, in case where there is a grounding object on the outer peripheral sides of the shields. Then, electrostatic capacity is constituted between the shields and the grounding object (hereinafter is appropriately referred to as "between adjacent electrodes").

That is, in case where the above-mentioned vacuum interrupter is simply incorporated in the vacuum breaker, fluctuations in potential due to the electrostatic capacity between the adjacent electrodes mentioned above easily occur, and there is a possibility that the balance of potential sharing inside the vacuum breaker is hardly kept. Consequently, it can be considered that an electric field locally rises or a desired insulation performance cannot be obtained.

In order to keep the balance of the potential sharing, for example, it can be considered to adjust electrostatic capacity by appropriately setting the distance between adjacent electrodes (by appropriately setting, for example, the shapes, arrangement configuration and the like of shields). However, there is a possibility that insulation distance becomes short caused by the adjustment, and insulation performance deteriorates.

Moreover, as shown in the patent document 1, in case where a vacuum vessel having a multistage insulating structure in which a plurality of cylindrical insulators are continuously provided simply, the dimension in the axial direction per cylindrical insulator becomes short. That is, a sufficient insulation distance cannot be secured, and there is a possibility that creeping discharge easily occurs on the outer peripheral side of the vacuum vessel.

In addition, although it can be considered to forcibly fix potential by arranging a voltage sharing capacitor in parallel with a vacuum interrupter as shown in the patent document 2, there is a possibility that the size of a vacuum breaker becomes large or costs become high.

The present invention has been made in consideration of such a technical problem, and an object of the present invention is to provide a technique capable of easily obtaining a desired insulation performance in a vacuum breaker by easily suppressing the creep discharge of a vacuum interrupter.

The vacuum interrupter and the vacuum breaker according to the present invention is one which is capable of contributing to solve the problem, and the vacuum interrupter, in one aspect thereof, includes: a vacuum vessel including an insulating cylindrical body, and having a fixed side which is one end side in an axial direction of the cylindrical body and is sealed with a fixed-side flange and a movable side which is the other end side in the axial direction and is sealed with a movable-side flange; a fixed-side energizing shaft extending from a vacuum vessel inner side of the fixed-side flange in the axial direction; a fixed electrode supported the an end portion on an extending direction side of the fixed-side energizing shaft; a movable-side energizing shaft which extends in the axial direction while passing through the movable-side flange in the axial direction, and is supported on the vacuum vessel inner side of the movable-side flange via a bellows which is extensible in the axial direction, so as to be movable in the axial direction; and a movable electrode which is supported on the end portion on the vacuum vessel inner side of the movable-side energizing shaft so as to face the fixed electrode, and comes in contact with and separates from the fixed electrode in accordance with the movement of the movable-side energizing shaft.

Then, the cylindrical body includes: a cylindrical arc shield which surrounds the outer peripheral side of the fixed electrode and the movable electrode; a fixed side insulating unit in which a cylindrical fixed-side insulator is provided so as to be connected coaxially with the arc shield on the fixed side in the axial direction of the arc shield; and a movable-side insulating unit in which cylindrical movable-side insulators are provided so as to be connected coaxially with the arc shield on the movable side in the axial direction of the arc shield, and the movable-side insulating unit includes: an insulator group in which a plurality of the movable-side insulators, a number of which is larger than that of the fixed-side insulator, are provided so as to be connected in the axial direction; a cylindrical insulator-group-side sub shield surrounding the outer peripheral side of the movable-side energizing shaft; and an insulator-group-side sub shield support part which is provided on the outer peripheral surface of the insulator-group-side sub shield, and is supported by being interposed between two adjacent movable-side insulators of the insulator group.

In one aspect of the vacuum interrupter, the inner diameter on the fixed side in the axial direction of the insulator-group-side sub shield may be smaller than that on the movable side in the axial direction of the insulator-group-side sub shield.

In addition, the vacuum interrupter may further include a cylindrical movable-side sub shield which extends from the vacuum vessel inner side of the movable-side flange in the axial direction and surrounds the outer peripheral side of the movable-side energizing shaft, on the inner peripheral side of the insulator-group-side sub shield, and the outer diameter of the movable-side sub shield may be smaller than the inner dimeter of the insulator-group-side sub shield, and the inner diameter of the movable-side sub shield may be larger than the outer diameter of the movable-side energizing shaft and the outer diameter of the movable electrode.

In addition, the distal end portion on the extending direction side of the movable-side sub shield may be formed with a movable-side reduced diameter portion having a shape bent toward the axis side of the movable-side sub shield.

In addition, the vacuum interrupter may further include a cylindrical fixed-side sub shield which extends from the vacuum vessel inner side of the fixed-side flange in the axial direction and surrounds the outer peripheral side of the fixed-side energizing shaft on the inner peripheral side of the arc shield, and the outer diameter of the fixed-side sub shield may be smaller than the inner dimeter of the arc shield, and the distal end portion on the extending direction side of the fixed-side sub shield may be positioned more on the fixed side in the axial direction than the contacts of the fixed electrode and the movable electrode.

In addition, the distal end portion on the extending direction side of the fixed-side sub shield may be formed with a fixed-side reduced diameter portion having a shape bent toward the axis side of the fixed-side sub shield.

In addition, the arc shield may be biased toward the fixed side in the axial direction from the contacts of the fixed electrode and the movable electrode.

In addition, the insulator-group-side sub shield may have characteristics that the outer diameter on the fixed side in the axial direction of the insulator-group-side sub shield is smaller than an inner diameter on the movable side in the axial direction of the arc shield, and the fixed side in the axial direction of the insulator-group-side sub shield is inserted into the inner peripheral side of the arc shield so as to be superimposed with the arc shield in the axial direction in a non-contact state with each other.

One aspect of the vacuum breaker is a vacuum breaker which is provided with a pair of the vacuum interrupters, and includes: a grounding tank which accommodates the pair of the vacuum interrupters arranged on the same line in a posture in which the movable-side flanges of the pair of the respective vacuum interrupters face each other; a link mechanism which is provided inside the grounding tank and electrically connects the movable-side energizing shafts of the pair of the respective vacuum interrupters so as to be freely movable in the axial direction; and an operation part which is provided on the outer peripheral side of the grounding tank and operates the link mechanism via an insulation operation rod connected to the link mechanism.

In one aspect of the vacuum breaker, cylindrical outer-peripheral-side sub shields surrounding outer peripheral sides of the respective fixed-side insulating units of the pair of the vacuum interrupters are provided on the outer peripheral sides of the respective fixed-side insulating units of the pair of the vacuum interrupters, and each of the outer-peripheral-side sub shields is superimposed with corresponding one of the arc shields of the respective vacuum interrupters in the axial direction.

According to the present invention mentioned above, it is possible to suppress the creep discharge of a vacuum interrupter so as to easily obtain a desired insulation performance in a vacuum breaker.

MODE FOR IMPLEMENTING THE INVENTION

Figure 1:
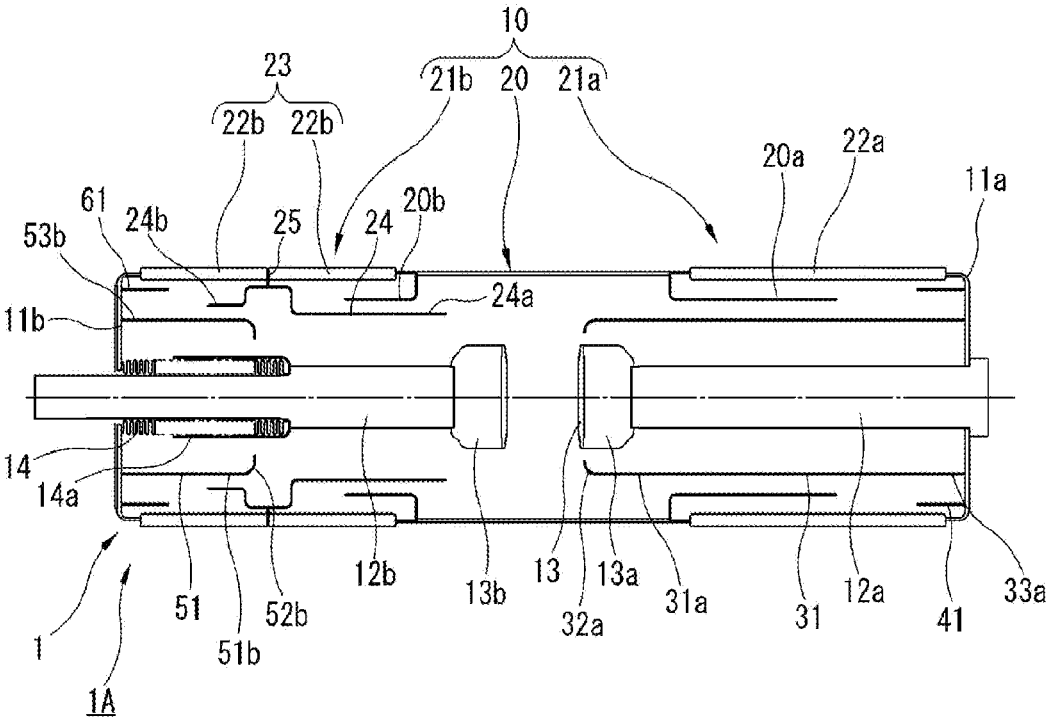
FIG. 1 is a schematic diagram for explaining a schematic configuration of a vacuum interrupter 1A (1B) in an embodiment (sectional view in the axial direction of a vacuum vessel 1 (in the right and left direction in the drawing)).

A vacuum interrupter and a vacuum breaker provided with the vacuum interrupter according to an embodiment of the present invention is totally different from the configuration (hereinafter is referred to as a conventional configuration) in which a plurality of shields are simply provided or a vacuum vessel having a multistage insulating structure is applied.

That is, in the vacuum interrupter and the vacuum breaker according to the present embodiment, the configuration on the fixed side (fixed electrode side) and the configuration on the movable side (movable electrode side) in the axial direction of the vacuum interrupter (hereinafter is simply referred to as an axial direction) are asymmetric, and as compared with the movable side of the vacuum interrupter, the fixed side is configured such that insulation distance can be easily secured, and as compared with the fixed side of the vacuum interrupter, the movable side is configured such that electrostatic capacity can be easily adjusted.

More specifically, a vacuum vessel which is capable of accommodating a fixed electrode (fixed side) and a movable electrode (movable side) so as to come in contact with and separate from each other in the axial direction includes a cylindrical arc shield surrounding the outer peripheral side of the fixed electrode and the movable electrode, a fixed side insulating unit in which a cylindrical fixed-side insulator is provided so as to be connected coaxially with the arc shield on the fixed side in the axial direction of the arc shield, and a movable-side insulating unit in which cylindrical movable-side insulators are provided so as to be connected coaxially with the arc shield on the movable side in the axial direction of the arc shield.

Then, in the movable-side insulating unit, there are provided with an insulator group in which a plurality of the movable-side insulators, the number of which is larger than that of the fixed-side insulator, are provided so as to be connected in the axial direction, a cylindrical insulator-group-side sub shield surrounding the outer peripheral side of a movable-side energizing shaft, and an insulator-group-side sub shield support part which is provided on the outer peripheral surface of the insulator-group-side sub shield, and is supported by being interposed between two adjacent movable-side insulators of the insulator group.

According to such an asymmetrical configuration, as compared with the movable electrode side of the vacuum interrupter, on the fixed electrode side, insulation distance can be easily secured, and it is possible to suppress creep discharge easily. On the other hand, as compared with the fixed electrode side of the vacuum interrupter, on the movable electrode side, the distance between adjacent electrodes is appropriately set, thereby adjusting electrostatic capacity easily.

In case of configuring a vacuum breaker by applying a pair of vacuum interrupters mentioned above, the pair of the vacuum interrupters arranged on the same line is accommodated in a grounding tank in a posture in which the movable electrode sides of the pair of the respective vacuum interrupters face each other.

Accordingly, although, for example, a high voltage which can be generated at the time of contact opening is applied from the fixed electrode side of the vacuum interrupter, on the fixed electrode side, insulation distance can be secured easily as mentioned above, and creep discharge can be sufficiently suppressed and an insulation breakdown phenomenon can also be suppressed.

On the movable electrode side of the vacuum interrupter, similar to the fixed electrode side, the applying of a high voltage can be suppressed, and even in case where, for example, the distance between adjacent electrodes is appropriately set (for example, the shape or arrangement configuration of the shields is appropriately set) to keep the balance of potential sharing so as to adjust electrostatic capacity, a sufficient insulation performance can also be secured on the movable electrode side.

Therefore, according to the vacuum breaker provided with the vacuum interrupter of the present embodiment, as compared with case where a conventional configuration is applied, a desired insulation performance can be obtained easily. In addition, even if, for example, a voltage sharing capacitor as shown in a patent document 3 is not applied, in the vacuum breaker, a desired insulation performance can be exhibited, and it is also possible to reduce the size and costs.

In the present embodiment, a vacuum interrupter has a asymmetrical configuration as mentioned above and a vacuum breaker is sufficient to have a configuration in which a pair of the vacuum interrupters is appropriately accommodated, and design change is possible by appropriately applying common general knowledge of various fields (such as a vacuum breaker field) while appropriately referring to prior art references as needed.

<<Embodiment of Vacuum Interrupter>>

FIG. 1 is one for explaining a schematic configuration of a vacuum interrupter 1A according to the present embodiment. In the vacuum interrupter 1A, a vacuum vessel 1 is used in which the fixed side in the axial direction of an insulating cylindrical body 10 is sealed with a fixed-side flange 11*a*, and the movable side in the axial direction is sealed with a movable-side flange 11*b*. Although, in the fixed-side flange 11*a* and the movable-side flange 11*b*, various modes can be applied, the application of, for example, a metal flange can be cited.

In the vacuum vessel 1, a columnar fixed-side energizing shaft 12*a* is provided on the vacuum vessel 1 inner side of the fixed-side flange 11*a* so as to movably extend toward the movable side in the axial direction from the vacuum vessel 1 inner side. A fixed electrode 13*a* having, for example, a plate shape is supported on the end portion on the movable side in the axial direction (extending direction side) of the fixed-side energizing shaft 12*a*.

In the movable-side flange 11*b*, a columnar movable-side energizing shaft 12*b* is provided so as to extend in the axial direction while passing through the movable-side flange 11*b* in the axial direction. The movable-side energizing shaft 12*b* is supported on the vacuum vessel 1 inner side of the movable-side flange 11*b* via a cylindrical bellows 14 which is extensible in the axial direction and is arranged coaxially with the movable-side energizing shaft 12*b*. With this, the movable-side energizing shaft 12*b* can be moved in the axial direction.

In case of the movable-side energizing shaft 12*b* in FIG. 1, a cylindrical bellows shield 14*a* is provided so as to surround and cover the outer peripheral side of the bellows 14.

In addition, a movable electrode 13*b* having, for example, a plate shape is supported on the end portion on the vacuum vessel 1 inner side of the movable-side energizing shaft 12*b*, so as to come in contact with and separate from the fixed electrode 13*a* in accordance with the movement in the axial direction of the movable-side energizing shaft 12*b*.

The cylindrical body 10 is mainly provided with a cylindrical arc shield 20 surrounding the outer peripheral side of the fixed electrode 13*a* and the movable electrode 13*b*, a fixed-side insulating unit 21*a* provided so as to be connected to the fixed side in the axial direction of the arc shield 20, and a movable-side insulating unit 21*b* provided so as to be connected to the movable side in the axial direction of the arc shield 20.

A fixed-side extending part 20*a* extending toward the fixed side in the axial direction along the inner peripheral side of the fixed-side insulating unit 21*a* is provided on the fixed side in the axial direction of the arc shield 20, and a movable-side extending part 20*b* extending toward the movable side in the axial direction along the inner peripheral side of the movable-side insulating unit 21*b* is provided on the movable side in the axial direction of the arc shield 20.

In case of the arc shield 20 in FIG. 1, the dimension in the axial direction of the fixed-side extending part 20*a* is longer than that in the axial direction of the movable-side extending part 20*b*. With this, the arc shield 20, as a whole, is configured so as to be biased toward the fixed side in the axial direction from contacts 13 of the fixed electrode 13*a* and the movable electrode 13*b*.

The fixed-side insulating unit 21*a* includes a cylindrical fixed-side insulator 22*a*, and the fixed-side insulator 22*a* is provided so as to be connected coaxially with the arc shield 20 on the fixed side in the axial direction of the arc shield 20.

The movable-side insulating unit 21*b* includes an insulator group 23 having a multistage insulating structure formed by a plurality of movable-side insulators 22*b* (two movable-side insulators 22*b* in FIG. 1), the number of which is larger than that of the fixed-side insulator 22*a*, and a cylindrical insulator-group-side sub shield 24 surrounding the outer peripheral side of the movable-side energizing shaft 12*b*.

The insulator group 23 is formed by arranging the movable-side insulators 22*b* so as to be aligned in the axial direction, and is provided so as to be connected coaxially with the art shield 20 on the movable side in the axial direction of the arc shield 20.

The insulator-group-side sub shield 24 is provided with an insulator-group-side sub shield support part 25 protruding from the outer peripheral surface of the insulator-group-side sub shield 24. The insulator-group-side sub shield support part 25 is supported by being interposed between two adjacent movable-side insulators 22*b* of the insulator group 23, and thereby the insulator-group-side sub shield 24 is supported by the insulator group 23.

In case of the insulator-group-side sub shield 24 in FIG. 1, the inner diameter of a one end portion 24*a* which is the fixed side in the axial direction of the insulator-group-side sub shield 24 is smaller than the inner diameter of an other end portion 24*b* which is the movable side in the axial direction of the insulator-group-side sub shield 24. In addition, the outer diameter of the one end portion 24*a* is smaller than the inner diameter of the movable-side extending part 20*b*. Moreover, the one end portion 24*a* is inserted into the inner peripheral side of the arc shield 20 (inner peripheral side of the movable-side extending part 20*b*) so as to be superimposed (overlap) with the arc shield 20 in the axial direction in a non-contact state with each other.

A cylindrical fixed-side sub shield 31 having a shape extending from the vacuum vessel 1 inner side toward the movable side in the axial direction is provided on the outer peripheral side of the fixed-side energizing shaft 12*a* on the fixed-side flange 11*a* side in the inside of the vacuum vessel 1, so as to surround the outer peripheral side of the fixed-side energizing shaft 12*a*.

In case of the fixed-side sub shield 31 in FIG. 1, the outer diameter of the fixed-side sub shield 31 is smaller than the inner diameter of the fixed-side extending part 20*a*. In addition, a distal end portion 31*a* on the movable side in the axial direction (extending direction side) of the fixed-side sub shield 31 is inserted into the inner peripheral side of the arc shield 20 (inner peripheral side of the fixed-side extending part 20*a*), so as to be superimposed with the arc shield 20 in the axial direction in a non-contact state with each other. Moreover, the distal end portion 31*a* is formed with a reduced diameter portion 32*a* having a shape bent toward the axis side of the fixed-side sub shield 31, and is positioned more on the fixed side in the axial direction than the contacts 13 of the fixed electrode 13*a* and the movable electrode 13*b*.

In addition, a cylindrical fixed-side electric field relieving shield 41 having a shape extending from the vacuum vessel 1 inner side toward the movable side in the axial direction is provided on the outer peripheral edge side (outer peripheral side of the fixed-side sub shield 31) on the vacuum vessel 1 inner side of the fixed-side flange 11*a*, so as to surround the outer peripheral side of a root portion 33*a* of the fixed-side sub shield 31.

A cylindrical movable-side sub shield 51 having a shape extending from the vacuum vessel 1 inner side toward the fixed side in the axial direction is provided on the outer peripheral side of the movable-side energizing shaft 12*b* on the vacuum vessel 1 inner side of the movable-side flange 11*b*, so as to surround the outer peripheral side of the movable-side energizing shaft 12*b*.

In case of the movable-side sub shield 51 in FIG. 1, the outer diameter of the movable-side sub shield 51 is smaller than the inner diameter of the other end portion 24*b* of the insulator-group-side sub shield 24. In addition, the inner diameter of the movable-side sub shield 51 is larger than the outer diameter of each of the movable-side energizing shaft 12*b* and the movable electrode 13*b*.

Moreover, a distal end portion 51*b* on the fixed side in the axial direction (extending direction side) of the movable-side sub shield 51 is inserted into the inner peripheral side of the insulator-group-side sub shield 24 (inner peripheral side of the other end portion 24*b*), so as to be superimposed with the insulator-group-side sub shield 24 in the axial direction in a non-contact state with each other. Furthermore, the distal end portion 51*b* is formed with a reduced diameter portion 52*b* having a shape bent toward the axis side of the movable-side sub shield 51.

In addition, a cylindrical movable-side electric field relieving shield 61 having a shape extending from the vacuum vessel 1 inner side toward the fixed side in the axial direction is provided on the outer peripheral edge side (outer peripheral side of the movable-side sub shield 51) on the vacuum vessel 1 inner side of the movable-side flange 11*b*, so as to surround the outer peripheral side of a root portion 53*b* of the movable-side sub shield 51.

According to the vacuum interrupter 1A shown in FIG. 1, on the fixed electrode 13*a* side of the vacuum interrupter 1A, as compared with the movable electrode 13*b* side, insulation distance can be secured easily, and creep discharge can be suppressed easily. On the other hand, on the movable electrode 13*b* side of the vacuum interrupter 1A, as compared with the fixed electrode 13*a* side, for example, the distance between adjacent electrodes according to each shield (for example, the distance between adjacent electrodes of the arch shield 20 and the insulator-group-side sub shield 24) is appropriately set, thereby easily adjusting electrostatic capacity.

<<Embodiment of Vacuum Breaker>>

Figure 2:
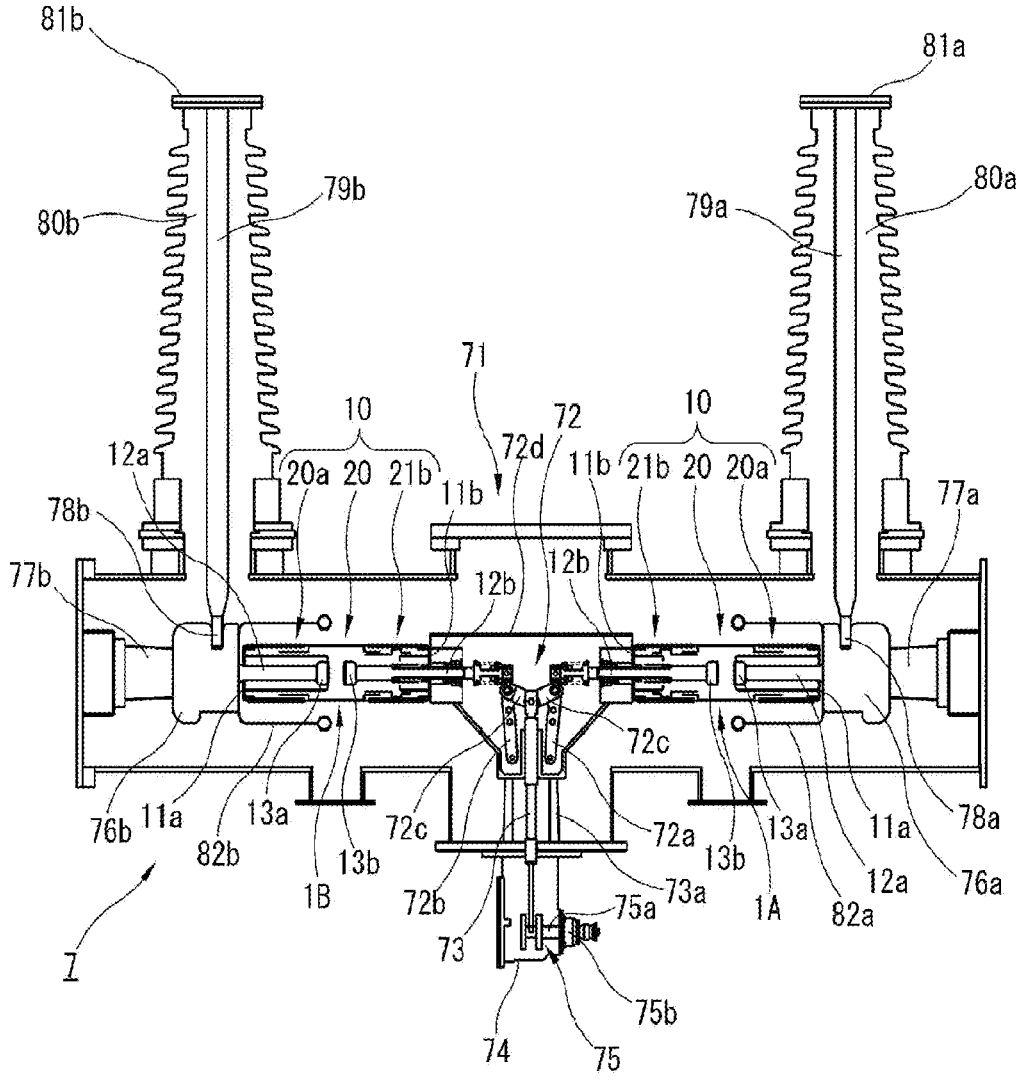
FIG. 2 is a schematic diagram for explaining a schematic configuration of a vacuum breaker 7 in an embodiment (sectional view in the axial direction of a grounding tank 71 (in the right and left direction in the drawing)).

FIG. 2 is one for explaining a schematic configuration of a vacuum breaker 7 in the present embodiment. In addition, when a component of FIG. 2 is the same as that of FIG. 1, the same symbol is applied, and redundant explanation is omitted. For example, the configuration of the after-mentioned vacuum interrupter 1B is similar to that of the vacuum interrupter 1A, and its detailed explanation is appropriately omitted.

The vacuum breaker 7 includes a grounding tank 71, a pair of vacuum interrupters 1A, 1B accommodated in the grounding tank 71, and a link mechanism 72 interposed between the vacuum interrupters 1A, 1B so as to open and close the vacuum interrupters 1A, 1B.

The ground tank 71 is one formed by using, for example, a cylindrical metal vessel, and has a structure which is capable of accommodating the vacuum interrupters 1A, 1B so as to be arranged on the same line in a posture in which movable-side flanges 11*b* of the respective vacuum interrupters 1A, 1B face each other. The inside of the grounding tank 71 is filled with, for example, an insulating gas (for example, $SF_6$).

The link mechanism 72 includes a link 72*a*, a link 72*b* and a link 72*c*, and is accommodated in a link mechanism case 72*d*. One end portion of the link 72*a* is rotatably supported inside the link mechanism case 72*d*, and the other end portion of the link 72*a* is supported rotatably to a movable-side energizing shaft 12*b* of the vacuum interrupter 1A. In addition, one end portion of the link 72*c* is rotatably provided to the link 72*a*, and the other end portion of the link 72*c* is rotatably supported on one end portion of an insulation operation rod 73 provided for the opening and closing operation of the vacuum interrupter 1A.

Similarly, one end portion of the link 72*b* is rotatably supported inside the link mechanism case 72*d*, and the other end portion of the link 72*b* is supported rotatably to a movable-side energizing shaft 12*b* of the vacuum interrupter 1B. In addition, one end portion of a link 72*c* is rotatably supported on the link 72*b*, and an end portion of the link 72*c* is rotatably supported on one end portion of the insulation operation rod 73.

The link mechanism case 72*d* accommodates the link mechanism 72, and electrically connects the movable-side energizing shaft 12*b* of the vacuum interrupter 1A and the movable-side energizing shaft 12*b* of the vacuum interrupter 1B. In addition, the link mechanism case 72*d* is interposed between the movable-side flanges 11*b* of the respective vacuum interrupters 1A, 1B so as to be supported via a support insulating tube 73*a* provided on the inner peripheral surface of the grounding tank 71.

The insulation operation rod 73 is provided so as to be inserted through the side portions of the link mechanism case 72*d*, the support insulating tube 73*a* and the grounding tank 71. The insertion portion of the insulation operation rod 73 which is the outer peripheral side of the grounding tank 71 is provided with an operation part 74.

The operation part 74 accommodates a converting mechanism 75, and is configured so as to convert the rotation motion of a rotation shaft 75*a* into the liner motion of the insulation operation rod 73 via the converting mechanism 75. One end of the rotation shaft 75*a* is exposed from the outer peripheral side of the operation part 74 via a rotation seal part 75*b*. With this, in the outside of the operation part 74, an operation mechanism (not shown) for operating the insulation operation rod 73 and an insulation operation rod (not shown) of another phrase can be driven interlocked with the rotation shaft 75*a*.

In the vacuum interrupter 1A, a conductor coupling part 76*a* electrically connected to the fixed-side energizing shaft 12*a* is provided on the outer side of the vacuum vessel 1 on the fixed-side flange 11*a* side, and is supported on the inner peripheral surface of the grounding tank 71 via a support insulator 77*a*. In addition, a conductor 79*a* is connected to the conductor coupling part 76*a* via a conductive metal fitting 78*a*.

Similar to the vacuum interrupter 1A, in the vacuum interrupter 1B, a conductor coupling part 76*b* electrically connected to the fixed-side energizing shaft 12*a* is provided on the outer side of the vacuum vessel 1 on the fixed-side flange 11*a* side, and is supported on the inner peripheral surface of the grounding tank 71 via a support insulator 77*b*. In addition, a conductor 79*b* is connected to the conductor coupling part 76*b* via a conductive metal fitting 78*b*.

The conductor 79*a* is provided in a state of protruding from the inside of the grounding tank 71 toward the outside of the grounding tank 71, and a bushing 80*a* is provided in the area surrounding the conductor 79*a*. The bushing 80*a* is supported on the grounding tank 71, and the distal end portion on the protruding direction side of the bushing 80*a* is provided with a bushing terminal 81*a* electrically connected to the conductor 79*a*.

Similar to the conductor 79*a* side, the conductor 79*b* is provided in a state of protruding from the inside of the grounding tank 71 toward the outside of the grounding tank 71, and a bushing 80*b* is provided in the area surrounding the conductor 79*b*. The bushing 80*b* is supported on the grounding tank 71, and the distal end portion on the protruding direction side of the bushing 80*b* is provided with a bushing terminal 81*b* electrically connected to the conductor 79*b*.

The outer peripheral side of the fixed-side insulating unit 21*a* of the vacuum interrupter 1A and the outer peripheral side of the fixed-side insulating unit 21*a* of the vacuum interrupter 1B are respectively provided with cylindrical outer-peripheral-side sub shields 82*a*, 82*b* surrounding the outer peripheral sides of the fixed-side insulating units 21*a*, and the outer-peripheral-side sub shield 82*a* is superimposed with the arc shield 20 of the vacuum interrupter 1A in the axial direction and the outer-peripheral-side sub shield 82*b* is superimposed with the arc shield 20 of the vacuum interrupter 1B in the axial direction.

In the input operation of the vacuum breaker 7 in FIG. 2, based on, for example, a desired input command, it is performed by the movement of the insulation operation rod 73 toward the inside direction (upper direction in FIG. 2) of the grounding tank 71 by a driving mechanism not shown (for example, a driving mechanism connected to the insulation operation rod 73). That is, the link 72*c* connected to the link 72*a* moves while tuning (in FIG. 2, rising while turning right) in accordance with the movement of the insulation operation rod 73. In accordance with this movement of the link 72*c*, the link 72*a* moves the movable-side energizing shaft 12*b* of the vacuum interrupter 1A toward the fixed electrode 13*a* side along the axial direction. Consequently, the fixed electrode 13*a* and the movable electrode 13*b* of the vacuum interrupter 1A are electrically connected to each other.

Similarly, the link 72*c* connected to the link 72*b* moves while tuning (in FIG. 2, rising while turning left) in accordance with the movement of the insulation operation rod 73. In accordance with this movement of the link 72*c*, the link 72*b* moves the movable-side energizing shaft 12*b* of the vacuum interrupter 1B toward the fixed electrode 13*a* side along the axial direction. Consequently, the fixed electrode 13*a* and the movable electrode 13*b* of the vacuum interrupter 1B are electrically connected to each other.

On the other hand, a cutoff operation is performed by the movement of the insulation operation rod 73 toward the outside direction (lower direction in FIG. 2) of the grounding tank 71. That is, by the operation reverse to the input operation, the movable-side energizing shaft 12*b* of the vacuum interrupter 1A moves in the direction separating from the vacuum interrupter 1A along the axial direction, and the movable electrode 13*b* separates from the fixed electrode 13*a* of the vacuum interrupter 1A.

Similarly, the movable-side energizing shaft 12*b* of the vacuum interrupter 1B moves in the direction separating from the vacuum interrupter 1B along the axial direction, and the movable electrode 13*b* separates from the fixed electrode 13*a* of the vacuum interrupter 1B.

In each of the vacuum interrupters 1A, 1B, in case of performing such an input operation and a cutoff operation mentioned above, even if the movable-side energizing shaft 12*b* moves, the vacuum state inside the vacuum vessel 1 is maintained by the extensible bellows 14. The bellows 14 of each of the vacuum interrupters 1A, 1B is one which is capable of withstanding the differential pressure between the vacuum on the outer peripheral side and an insulating gas (for example, $SF_6$) on the inner peripheral side to a certain extent.

<<Electrostatic Capacity Characteristic>>

Figure 4:
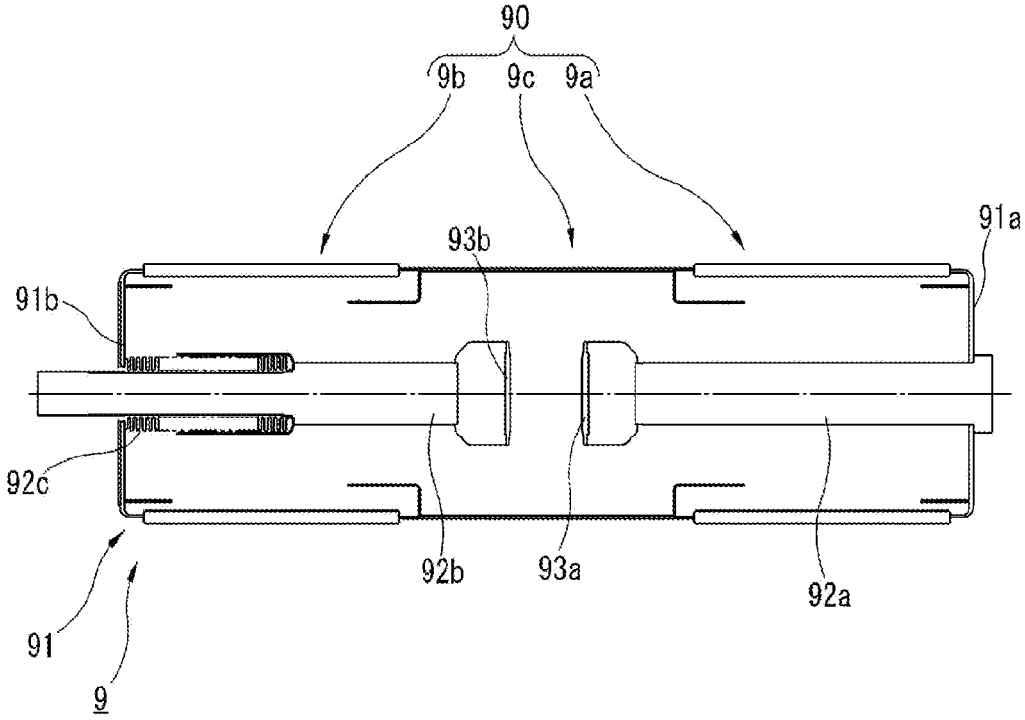
FIG. 4 is a schematic diagram for explaining one example of a common vacuum interrupter.

Next, electrostatic capacity characteristics of the vacuum breaker 7 shown in FIG. 2 will be explained while comparing with electrostatic capacity characteristics in case where the vacuum interrupter 9 shown in FIG. 4 is applied.

First, when focusing on the vacuum interrupter 9 shown in FIG. 4, since the configuration on the fixed side (fixed electrode 93*a* side) and the configuration on the movable side (movable electrode 93*b* side) in the axial direction of the vacuum interrupter 9 are symmetrical to each other, it can be understood that the electrostatic capacity between adjacent electrodes of the fixed-side energizing shaft 92*a* and the arc shield 9*c* is the same as that between adjacent electrodes of the movable-side energizing shaft 92*b* and the arc shield 9*c*. In addition, it can be considered that when an application voltage is set as 100%, the potential of the arc shield 9*c* is 50% (50% of the application voltage).

However, since the arc shield 9*c* acts as a floating electrode, in case where there is a grounding object such as a grounding tank around the arc shield 9*c*, the effect of an electrostatic capacity Cf between adjacent electrodes of the arc shield 9*c* and a grounding object can be considered. That is, the potential of the arc shield 9*c* is lowered, and the potential difference between a high voltage side and the arc shield 9*c* becomes large.

Figure 5:
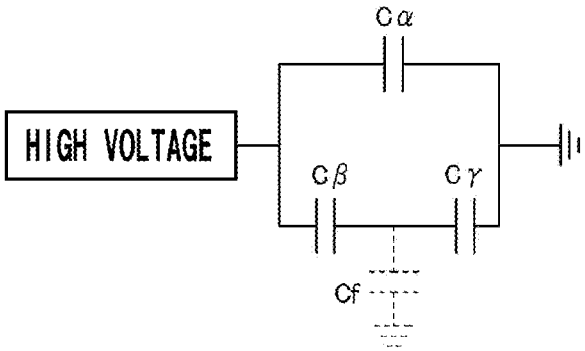
FIG. 5 is an equivalent circuit diagram for explaining electrostatic capacity characteristics in case where the vacuum interrupter 9 is applied.

In case of accommodating such a vacuum interrupter 9 in a grounding tank of a vacuum breaker, its equivalent circuit is shown in FIG. 5. In addition, in FIG. 5, Cα indicates an electrostatic capacity between adjacent electrodes of the fixed electrode 93*a* and the movable electrode 93*b*, Cβ indicates an electrostatic capacity between adjacent electrodes of the movable-side energizing shaft 92*b* and the arc shield 9*c*, and Cγ indicates an electrostatic capacity between adjacent electrodes of the fixed-side energizing shaft 92*a* and the arc shield 9*c*.

In FIG. 5, it can be understood that, in order to suppress fluctuations in the potential of the arc shield 9*c*, the electrostatic capacities Cβ, Cγ need to be larger than the electrostatic capacity Cf.

Figure 3:
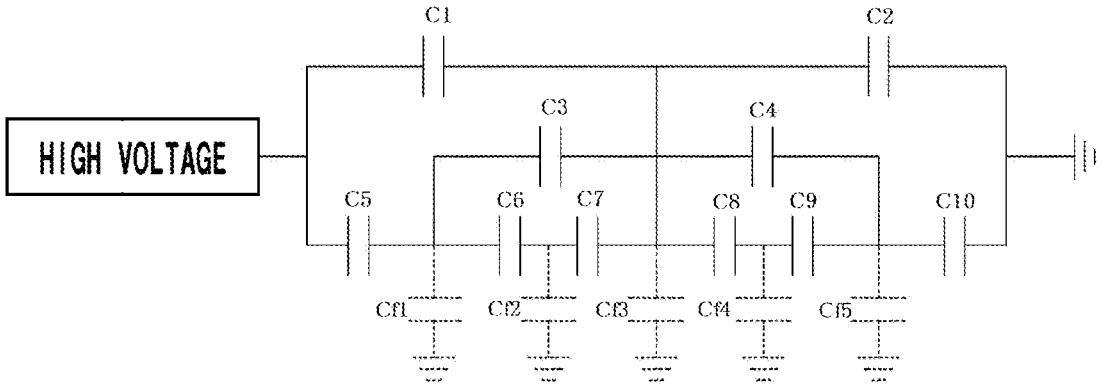
FIG. 3 is an equivalent circuit diagram for explaining electrostatic capacity characteristics of the vacuum breaker 7.

On the other hand, the equivalent circuit of the vacuum breaker 7 shown in FIG. 2 is as shown in FIG. 3. In addition, C1, C3, C5, C6, C7, Cf1 and Cf2 indicate electrostatic capacities according to the vacuum interrupter 1A, and C2, C4, C8, C9, C10, Cf4 and Cf5 indicate electrostatic capacities according to the vacuum interrupter 1B.

More specifically, C1 indicates an electrostatic capacity between adjacent electrodes of the fixed electrode 13*a* and the movable electrode 13*b* in the vacuum interrupter 1A, C2 indicates an electrostatic capacity between adjacent electrodes of the fixed electrode 13*a* and the movable electrode 13*b* in the vacuum interrupter 1B, C3 indicates an electrostatic capacity between adjacent electrodes of the arc shield 20 and the movable-side energizing shaft 12*b* in the vacuum interrupter 1A, C4 indicates an electrostatic capacity between adjacent electrodes of the arc shield 20 and the movable-side energizing shaft 12*b* in the vacuum interrupter 1B, C5 indicates an electrostatic capacity between adjacent electrodes of the arc shield 20 and the fixed-side energizing shaft 12*a* (or fixed-side sub shield 31) in the vacuum interrupter 1A, C10 indicates an electrostatic capacity between adjacent electrodes of the arc shield 20 and the fixed-side energizing shaft 12*a* (or fixed-side sub shield 31) in the vacuum interrupter 1B, C6 indicates an electrostatic capacity between adjacent electrodes of the arc shield 20 and the insulator-group-side sub shield 24 in the vacuum interrupter 1A, C9 indicates an electrostatic capacity between adjacent electrodes of the arc shield 20 and the insulator-group-side sub shield 24 in the vacuum interrupter 1B, C7 indicates an electrostatic capacity between adjacent electrodes of the movable-side energizing shaft 12*b* (or the movable-side sub shield 51) and the insulator-group-side sub shield 24 in the vacuum interrupter 1A, C8 indicates an electrostatic capacity between adjacent electrodes of the movable-side energizing shaft 12*b* (or the movable-side sub shield 51) and the insulator-group-side sub shield 24 in the vacuum interrupter 1B, Cf1 indicates an electrostatic capacity between adjacent electrodes of the arc shield 20 and the grounding tank 71 in the vacuum interrupter 1A, Cf5 indicates an electrostatic capacity between adjacent electrodes of the arc shield 20 and the grounding tank 71 in the vacuum interrupter 1B, Cf2 indicates an electrostatic capacity between adjacent electrodes of the insulator-group-side sub shield 24 and the grounding tank 71 in the vacuum interrupter 1A, Cf4 indicates an electrostatic capacity between adjacent electrodes of the insulator-group-side sub shield 24 and the grounding tank 71 in the vacuum interrupter 1B, and Cf3 indicates an electrostatic capacity between adjacent electrodes of the link mechanism 72 and the grounding tank 71.

In FIG. 2 and FIG. 3, it can be understood that a floating electrode in the vacuum breaker 7 mainly exists at five spots of the connection point (electrostatic capacity Cf3) in which the link mechanism 72 is accommodated, in addition to the arc shields 20 (electrostatic capacities CF1, Cf5), the insulator-group-side sub shields 24 (electrostatic capacities Cf2, Cf4) of the respective vacuum interrupters 1A, 1B.

In case of the vacuum breaker 7, in the vacuum interrupters 1A, 1B, the distance between contacts can be sufficiently separated at the time of contact opening, and it can be read that when the facing area of the arc shield 20 and the movable-side energizing shaft 12*b* is small, the values of the electrostatic capacities C1, C2, C3, C4 become small to a negligible extent, as compared with electrostatic capacities between adjacent electrodes of the others. That is, in order to equalize the potential sharing inside the vacuum breaker 7, it can be considered to increase the values of the electrostatic capacities C5-C10.

In general, in an electrostatic capacity C between adjacent electrodes of two cylindrical electrodes coaxially arranged like a vacuum interrupter, the relation shown in the following formula (1) is established. In addition, in the following formula (1), "L" indicates the length in the axial direction of a cylindrical electrode, "a" indicates the radius of a cylindrical electrode on the inner side, "b" indicates the radius of a cylindrical electrode on the outer side, and "In" indicates a natural logarithm.

$$C=2\pi\varepsilon 74\ L(\ln(b/a)) \quad (1)$$

In case of the vacuum breaker 7 shown in FIG. 2, as compared with the distance between adjacent electrodes of the arc shield 20 and the insulator-group-side sub shield 24 in each of the vacuum interrupters 1A, 1B (electrostatic capacities C6, C9) and the distance between adjacent electrodes of the insulator-group-side sub shield 24 and the movable-side sub shield 51 in each of the vacuum interrupters 1A, 1B (electrostatic capacities C7, C8), in the arc shield 20 and the fixed-side sub shield 31 in each of the vacuum interrupters 1A, 1B, the distance between adjacent electrodes (electrostatic capacities C5, C10) is large, and the superimposed distance is also large. Therefore, it can be understood that, each of the electrostatic capacities C5, C10 can be adjusted by mainly adjusting "L" in the formula (1).

In addition, since the outer-peripheral-side sub shields 82*a*, 82*b* are arranged so as to be superimposed with the respective arc shields 20, the electric field facing in the direction parallel to the creeping surface of each of the fixed-side insulating units 21 of the vacuum interrupters 1A, 1B can be bent in the vertical direction, and consequently, creeping discharge can be suppressed easier. Moreover, the potential distribution inside the vacuum breaker 7 can also be adjusted by shielding part of each of the electrostatic capacities Cf1, Cf5 generated between the arc shields 20 and the grounding tank 71.

Although the fixed-side sub shields 31 of the vacuum interrupters 1A, 1B are arranged in order to mainly adjust the electrostatic capacities between adjacent electrodes of the fixed-side sub shields 31 and the arch shields 20, by adjusting each of the distal end portions 31*a* of the fixed-side sub shields 31 so as to extend to a position near corresponding one of the contacts 13, the electric fields of the contacts 13 can also be relaxed.

However, if the fixed-side sub shields 31 are adjusted such that the distal end portions 31*a* extend to positions more on the movable side in the axial direction than the contacts 13, there is a possibility that the arc generated when electric current is cut off is ignited to the fixed-side sub shields 31, and breaking performance deteriorates. Therefore, it is preferable to adjust and extend the fixed-side sub shields 31 such that the distal end portions 31*a* are positioned more on the fixed side in the axial direction than the contacts 13 as shown in FIG. 1 and FIG. 2.

In addition, in case where the fixed-side sub shields 31 are arranged in order to only adjust electrostatic capacity as mentioned above, it can be substituted by increasing the size of the fixed-side energizing shafts 12*a*.

In the electrostatic capacities C6-C9, by decreasing the distance between adjacent electrodes in each of them, the denominator in the formula (1) is made small, and the electrostatic capacities can be increased. In general, it is known that the dielectric breakdown voltage in vacuum is proportional to the approximately 0.5 power of the distance. That is, in case where, in each of the electrostatic capacities, an insulation distance D is the same, as compered with case where insulation is secured at one spot, in the configuration in which electrodes having a half distance d/2 therebetween are provided at two spots, a compact design can be realized.

In case of the vacuum breaker 7 in FIG. 3, four electrodes (C6-C9) exist between arc shields of the respective vacuum interrupters 1A, 1B. That is, even if the distance between electrodes is reduced in order to form a high electrostatic capacity, it is possible to design the vacuum breaker 7 in order to sufficiently maintain a desired dielectric breakdown characteristic in the vacuum interrupters 1A, 1B.

The vacuum breaker 7 mentioned above can also be considered which have a configuration in which characteristics of a so-called double-break vacuum breaker are combined with the dielectric breakdown phenomenon in vacuum. In addition, even if a voltage sharing capacitor as shown in the patent document 3 is not used, the potential distribution inside the vacuum breaker 7 can be appropriately adjusted, and an increase in voltage and a decrease in size of the vacuum breaker 7 become possible.

As the above, although one embodiment of the present invention has been explained in detail, it is obvious to a person skilled in the art that the present invention is not limited to the above embodiment, and various changes can be carried out within the technical scope of the present invention, and it is obvious that such a change belongs to the scope of the claims.

The invention claimed is:

1. A vacuum interrupter comprising:

a vacuum vessel including an insulating cylindrical body, and having a fixed side which is one end side in an axial direction of the cylindrical body and is sealed with a fixed-side flange and a movable side which is an other end side in the axial direction and is sealed with a movable-side flange;

a fixed-side energizing shaft extending from a vacuum vessel inner side of the fixed-side flange in the axial direction;

a fixed electrode supported on an end portion on an extending direction side of the fixed-side energizing shaft;

a movable-side energizing shaft which extends in the axial direction while passing through the movable-side flange in the axial direction, and is supported on the vacuum vessel inner side of the movable-side flange via a bellows which is extensible in the axial direction, so as to be movable in the axial direction; and a movable electrode which is supported on an end portion on the vacuum vessel inner side of the movable-side energizing shaft so as to face the fixed electrode, and comes in contact with and separates from the fixed electrode in accordance with a movement of the movable-side energizing shaft, wherein the cylindrical body includes:

a cylindrical arc shield which surrounds an outer peripheral side of the fixed electrode and the movable electrode;

a fixed side insulating unit in which a cylindrical fixed-side insulator is provided so as to be connected coaxially with the arc shield on the fixed side in the axial direction of the arc shield; and a movable-side insulating unit in which cylindrical movable-side insulators are provided so as to be connected coaxially with the arc shield on the movable side in the axial direction of the arc shield, and wherein the movable-side insulating unit includes:

an insulator group in which a plurality of the movable-side insulators, a number of which is larger than that of the fixed-side insulator, are provided so as to be connected in the axial direction;

a cylindrical insulator-group-side sub shield surrounding an outer peripheral side of the movable-side energizing shaft; and an insulator-group-side sub shield support part which is provided on an outer peripheral surface of the insulator-group-side sub shield, and is supported by being interposed between two adjacent movable-side insulators of the insulator group.

2. The vacuum interrupter according to claim 1, wherein the insulator group-side sub shield has a first end portion extending toward the fixed side in the axial direction and a second end portion extending toward the movable side in the axial direction, and an inner diameter of the first end portion of the insulator-group-side sub shield is smaller than that of the second end portion.

3. The vacuum interrupter according to claim 1, further comprising a cylindrical movable-side sub shield which extends from the vacuum vessel inner side of the movable-side flange in the axial direction and surrounds an outer peripheral side of the movable-side energizing shaft, on an inner peripheral side of the insulator-group-side sub shield, wherein:

the movable-side sub shield has an outer diameter and an inner diameter with respect to the movable-side energizing shaft;

the insulator-group-side sub shield has an inner diameter with respect to the movable-side energizing shaft, and the outer diameter of the movable-side sub shield is smaller than the inner diameter of the insulator-group-side sub shield;

the movable-side energizing shaft has an outer diameter in the axial direction and the movable electrode has an outer diameter in the axial direction, and the inner diameter of the movable-side sub shield is larger than the outer diameter of the movable-side energizing shaft and the outer diameter of the movable electrode.

4. The vacuum interrupter according to claim 3, wherein an distal end portion on an extending direction side of the movable-side sub shield is formed with a movable-side reduced diameter portion having a shape bent toward an axis side of the movable-side sub shield.

5. The vacuum interrupter according to claim 1, further comprising a cylindrical fixed-side sub shield which extends from the vacuum vessel inner side of the fixed-side flange in the axial direction and surrounds an outer peripheral side of the fixed-side energizing shaft, on an inner peripheral side of the arc shield, wherein an outer diameter of the fixed-side sub shield is smaller than an inner dimeter of the arc shield, and a distal end portion on an extending direction side of the fixed-side sub shield is positioned more on the fixed side in the axial direction than contacts of the fixed electrode and the movable electrode.

6. The vacuum interrupter according to claim 5, wherein the distal end portion on the extending direction side of the fixed-side sub shield is formed with a fixed-side reduced diameter portion having a shape bent toward an axis side of the fixed-side sub shield.

7. The vacuum interrupter according to claim 1, wherein a center position in the axial direction of the arc shield is located at a position closer to the fixed side in the axial direction than to contacts of the fixed electrode and the movable electrode.

8. The vacuum interrupter according to claim 1, wherein an outer diameter on the fixed side in the axial direction of the insulator-group-side sub shield is smaller than an inner diameter on the movable side in the axial direction of the arc shield, and wherein the fixed side in the axial direction of the insulator-group-side sub shield is inserted into an inner peripheral side of the arc shield so as to be superimposed with the arc shield in the axial direction in a non-contact state with each other.

9. A vacuum breaker provided with a pair of the vacuum interrupters according to claim 1, comprising:

a grounding tank which accommodates the pair of the vacuum interrupters arranged on a same line in a posture in which the movable-side flanges of the pair of the respective vacuum interrupters face each other;

a link mechanism which is provided inside the grounding tank and electrically connects the movable-side energizing shafts of the pair of the respective vacuum interrupters so as to be freely movable in the axial direction; and an operation part which is provided on an outer peripheral side of the grounding tank and operates the link mechanism via an insulation operation rod connected to the link mechanism.

10. The vacuum breaker according to claim 9, wherein cylindrical outer-peripheral-side sub shields surrounding respective outer peripheral sides of the fixed-side insulating units of the pair of the vacuum interrupters are provided on the respective outer peripheral sides of the fixed-side insulating units, and wherein each of the outer-peripheral-side sub shields is superimposed with corresponding one of the arc shields of the vacuum interrupters in the axial direction.

* * * * *